US006276828B1

(12) United States Patent
Otley et al.

(10) Patent No.: US 6,276,828 B1
(45) Date of Patent: Aug. 21, 2001

(54) BEACH TOWEL/TOTE BAG

(76) Inventors: Tamara D. Otley, 20370 Via Pizarro, Yorba Linda, CA (US) 92886-3048; Kristin K. Varadi-Saul, 8968 SW. Joe Ct., Tigard, OR (US) 97223

( * ) Notice: Subject to any disclaimer, the term of this patent is extended or adjusted under 35 U.S.C. 154(b) by 0 days.

(21) Appl. No.: 09/613,021

(22) Filed: Jul. 10, 2000

Related U.S. Application Data

(60) Provisional application No. 60/145,199, filed on Jul. 23, 1999.

(51) Int. Cl.[7] ..... B65D 30/00

(52) U.S. Cl. ..... 383/4; 383/18; 383/38; 224/576; 5/417

(58) Field of Search ..... 383/4, 18, 38, 383/117; 224/576, 577; 5/417, 419

(56) References Cited

U.S. PATENT DOCUMENTS

| | | | | |
|---|---|---|---|---|
| 3,477,552 | * | 11/1969 | Goldman | 5/417 X |
| 4,197,891 | | 4/1980 | Comollo . | |
| 4,587,682 | * | 5/1986 | Schultz | 383/4 X |
| 4,671,393 | * | 6/1987 | Rainey | 383/4 X |
| 4,856,912 | | 8/1989 | Damus et al. . | |
| 4,886,150 | * | 12/1989 | Fitzsimmons | 383/4 X |
| 5,110,219 | | 5/1992 | Lopes . | |
| 5,346,308 | | 9/1994 | Buhol et al. . | |
| 5,370,460 | * | 12/1994 | Nelson | 383/4 |
| 5,390,381 | | 2/1995 | La Mantia . | |
| 5,533,653 | | 7/1996 | Kaufman . | |
| 5,618,110 | | 4/1997 | Sullivan . | |
| 5,629,071 | | 5/1997 | Feldman . | |
| 5,688,052 | | 11/1997 | Compton . | |
| 5,737,785 | * | 4/1998 | Casey | 5/419 |
| 5,785,219 | * | 7/1998 | Kraft | 224/576 |
| 5,941,638 | * | 8/1999 | Fonseca | 383/4 |
| 5,979,722 | * | 11/1999 | Gonzales | 224/576 X |

FOREIGN PATENT DOCUMENTS

| | | | | |
|---|---|---|---|---|
| 819449 | * | 10/1951 | (DE) | 383/4 |

* cited by examiner

*Primary Examiner*—Jes F. Pascua
(74) *Attorney, Agent, or Firm*—Charles S. Gumpel

(57) ABSTRACT

The invention relates to a beach towel, which converts to a compact tote bag incorporating externally accessible pockets for carrying various accessories. The beach towel is formed from a large rectangular section of flexible, absorbent fabric and a second smaller, multi-paneled rectangular towel consisting mostly of the same or similar fabric as the large towel. The small towel overlies the upper one-quarter section of the large towel and the two are stitched together along the center and periphery of the small towel. Pockets with zippered closures are provided on the outside face of the small towel, and its center section is made from a flexible perforated screen or mesh fabric to facilitates escape of dirt and sand particles entrapped within the pockets. The towel converts to the tote bag configuration by folding it twice along the transverse axis and once along the longitudinal axis. Securing snaps are provided to hold the towel in the tote bag configuration, and two strap loops form handles for carrying in any desired manner, including on one shoulder, or as a backpack. The partially unfolded towel is also convertible to a shoulder and back cover to protect the wearer from adverse weather conditions.

17 Claims, 3 Drawing Sheets

BEACH TOWEL/TOTE BAG

This application claims benefit of Prov. No. 60/145,199 filed Jul. 23, 1999.

BACKGROUND OF THE INVENTION

1. Field of the Invention

This invention is directed to an improved beach towel and tote bag combination for use when lounging at a beach or other recreational area. The towel incorporates novel features that allow for simple and rapid conversion to a tote bag configuration, and includes externally accessible pockets that serve a primary purpose of carrying loose articles, a secondary purpose of providing a headrest for the user, and the combination serves a tertiary purpose of providing a shoulder or back cover to protect the user from undesired weather conditions. The storage pockets incorporate a novel feature to facilitate removal of sand or dirt particles collected during use.

2. Description of Related Art

Excursions to the beach or other recreation areas generally involve long walks to the ultimate destination because available parking lots, train and bus stations are usually located at a considerable distance. To enjoy those excursions, people usually carry a beach towel, blanket, or mat as well as other containers or tote bags for transporting various personal items, such as food, drinks, clothing, reading materials, sunglasses, suntan lotion, etc. Carrying all the separate equipment and provisions results in substantial discomfort and inconvenience and may necessitate several trips before everything is in place. It is accordingly highly advantageous to combine items so as to reduce the total number to be carried. To that end, various attempts have been made in the past to provide combination tote bags and towels with storage pockets and carrying straps. By so doing, the total number of separate items that must be carried is significantly reduced.

Information relevant to attempts to address this problem can be found in U.S. Pat. Nos. 4,197,891 to Comollo, 4,856,912 to Damus et al, 5,110,219 to Lopes, 5,346,308 to Buhot et al, 5,390,381 to LaMantia, 5,533,653 to Kaufman, 5,629,071 to Feldman, 5,618,110 to Sullivan, 5,688,052 to Compton. However, these references suffers from one or more of the following disadvantages:

a) no separate provisions for carrying small items, such as valuables;

b) the towel, when converted to a tote bag, is large and cumbersome and difficult to carry;

c) long zippers, subject to jamming as a result of being contaminated with sand and dirt, are employed as the means for securing the towel in the folded, tote bag, configuration;

d) multi-step, complex, and confusing folding schemes are employed, and are either ignored or most likely employed only if special instructions are provided and followed;

e) the folding schemes are such that sand and dirt particles will end up inside the tote bag and thus are carried home by the user who must then take special steps to dispose of them; and f) no provisions are incorporated to facilitate use of the towel as a shoulder or back cover to protect the user from undesired weather conditions.

For the foregoing reasons, there is a need for a towel and tote bag combination designed for simple and rapid conversion that can be readily accomplished by anyone, including most children. There is also a need for the tote bag to have convenient externally accessible pockets, which incorporate a novel means for removal of sand or dirt particles collected during use at a beach or other recreational area. Finally, there is a need for a beach towel that can also be utilized as a means of protecting the user from undesired weather conditions, such as excessive sun, wind, or cold.

SUMMARY OF THE INVENTION

The beach towel/tote bag invention is directed to an improved beach towel and tote bag combination that satisfies these needs. In the preferred embodiment, the invention comprises a large rectangular beach towel of flexible, absorbent, fabric sized approximately twice as long as it is wide, and a small beach towel, of the same or similar fabric, cut to one quarter of the length and the same width as the large towel. The small towel is cut in half and a strip of perforated mesh or screen fabric, approximately three inches wide and as long as the small towel's width, is stitched in-between the two small towel halves. A transverse cut is made at a line approximately four inches from each opposing edge of the small towel, and each cut section is reattached to the remaining portion of the small towel by means of zippers or other equivalent closure means. The small towel is then placed flat, zippers facing out, over the matching upper quarter section of the large towel, and the two towels stitched together along the longitudinal centerline of the strip of perforated mesh or screen fabric. The small towel ends are then lined up with the large towel sides, and the two towels stitched together along the small towel's perimeter, incorporating small pleats at the mesh fabric extremities, thus forming two zippered pockets on the front upper quarter section of the large towel. The strips of perforated mesh or screen fabric provide a novel escape path for dirt or sand trapped in the pockets during use at a beach or recreation area.

Straps are stitched along the longitudinal edges of the small towel, extending beyond the side edges of the large towel, creating a loop on each side. The loops are for use as tote bag or backpack carrying straps. Small loop tabs are stitched to both front side edges of the large towel at the longitudinal centerline, and one half of a snap secured to each loop tab facing the back side of the large towel. The matching half of each cooperating snap is secured to the backside edge of the upper loop straps, so that the snaps will match and secure the large towel halves when they are folded onto each other along the transverse centerline.

Beach towel/tote bag is folded into a tote bag configuration following very simple and easily understood steps. The first step involves folding the backside of large towel in half at the transverse centerline and then lifting it by the loop tabs with the snaps facing away. Beach towel/tote bag is then shaken to loosen and remove accumulated sand, dirt or grass. The large towel is again folded transversely on its backside to form a quarter segment, and the matching cooperating snaps secured to each other. The final fold is made along the longitudinal axes so that the loop straps line up with each other forming the tote bag configuration. Beach towel/tote bag is again shaken to remove, through the mesh or screen fabric panel at the bottom of each pocket, sand and dirt collected during use.

In the first mode of operation, beach towel/tote bag is placed on the ground or sand to lie on, the zippered pockets facing down. Soft items in the pockets will form pillows to support the user's head when lying on the towel. After folding as hereinabove described, beach towel/tote bag can be carried as a tote bag by putting both straps on one shoulder or as a backpack by putting one strap on each shoulder with the pockets facing out.

In the second mode of operation, beach towel/tote bag can be used as a cover by unfolding the final longitudinal fold, but not disengaging the snaps, placing over the shoulders with the pockets facing out, and bringing the straps around the user's front. If desired, arms may be placed through the loops of the straps to hold beach towel/tote bag on the shoulders.

In a third mode of operation, beach towel/tote bag can be used as an extended cover by unfolding to half the large towel's length, but not disengaging the snaps, placing over the shoulders with the pockets facing out, and bringing the straps around the user's front. If desired, arms may be placed through the loops of the straps to hold beach towel/tote bag on the shoulders.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Figure 1:
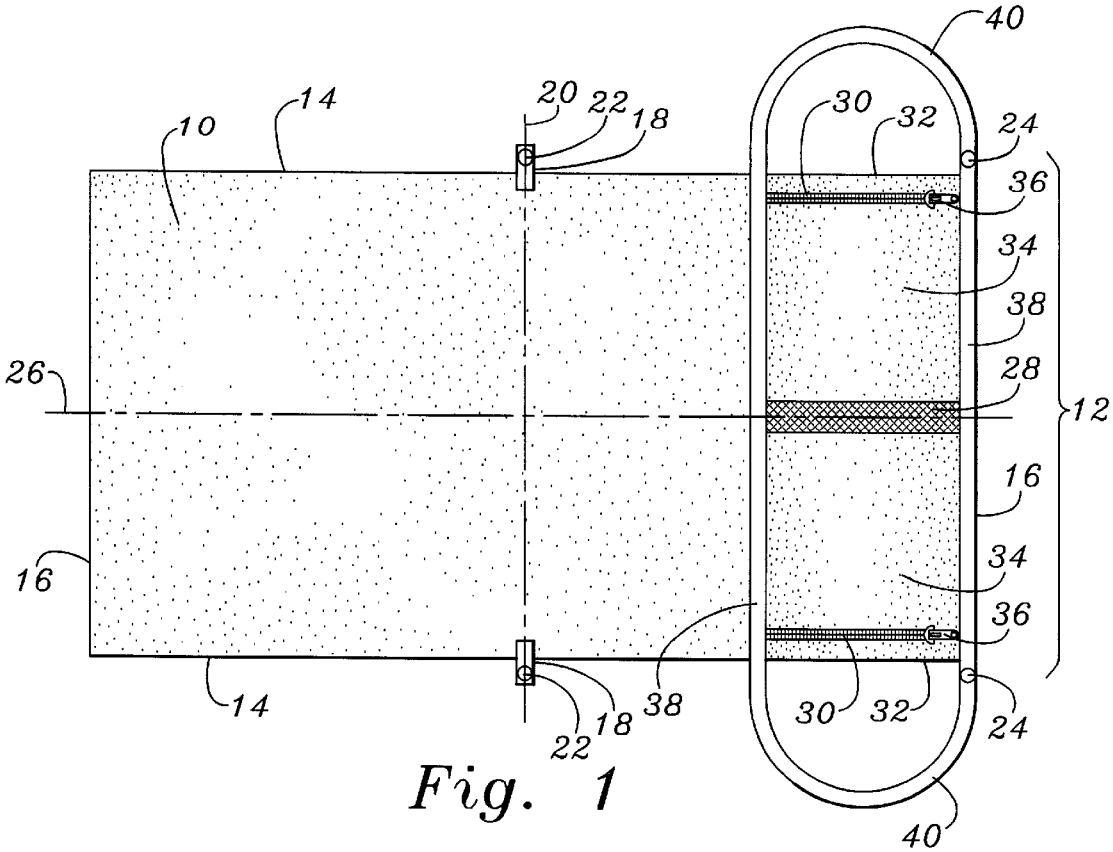
FIG. 1 is a front view of the beach towel/tote bag showing the combined large towel and small towel, the partially vented pockets, and the carrying straps.
Figure 2:
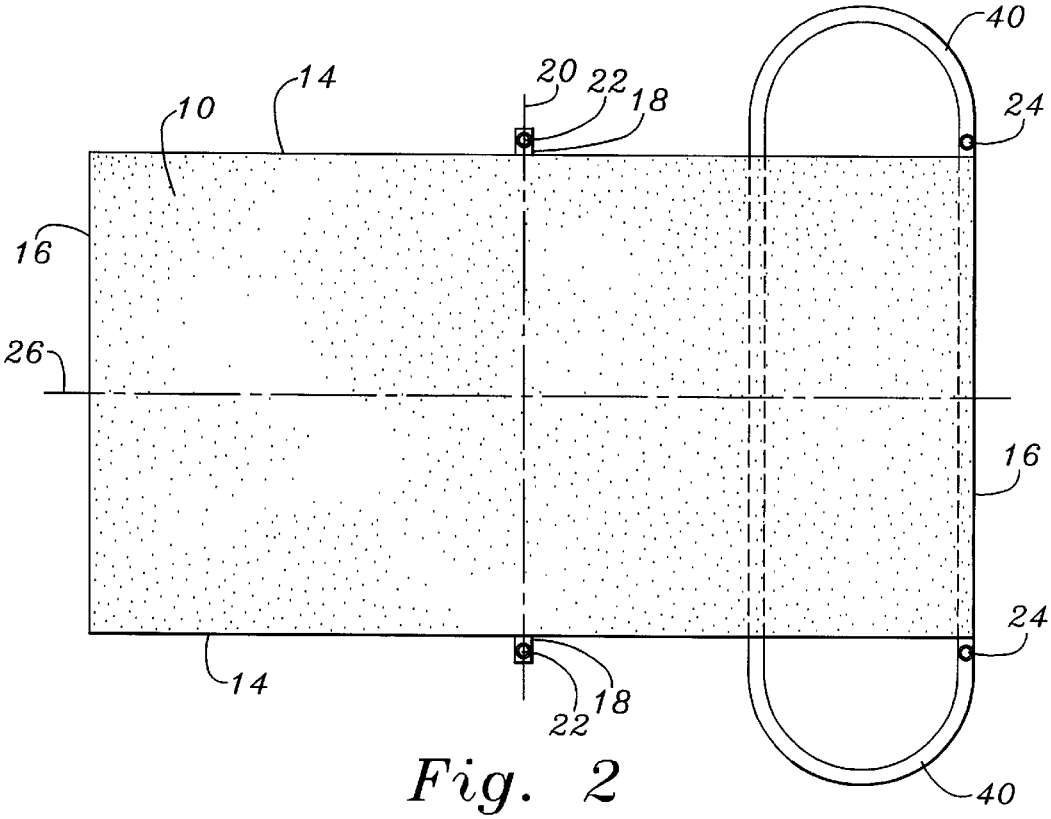
FIG. 2 is a back view of the beach towel/tote bag.
Figure 3:
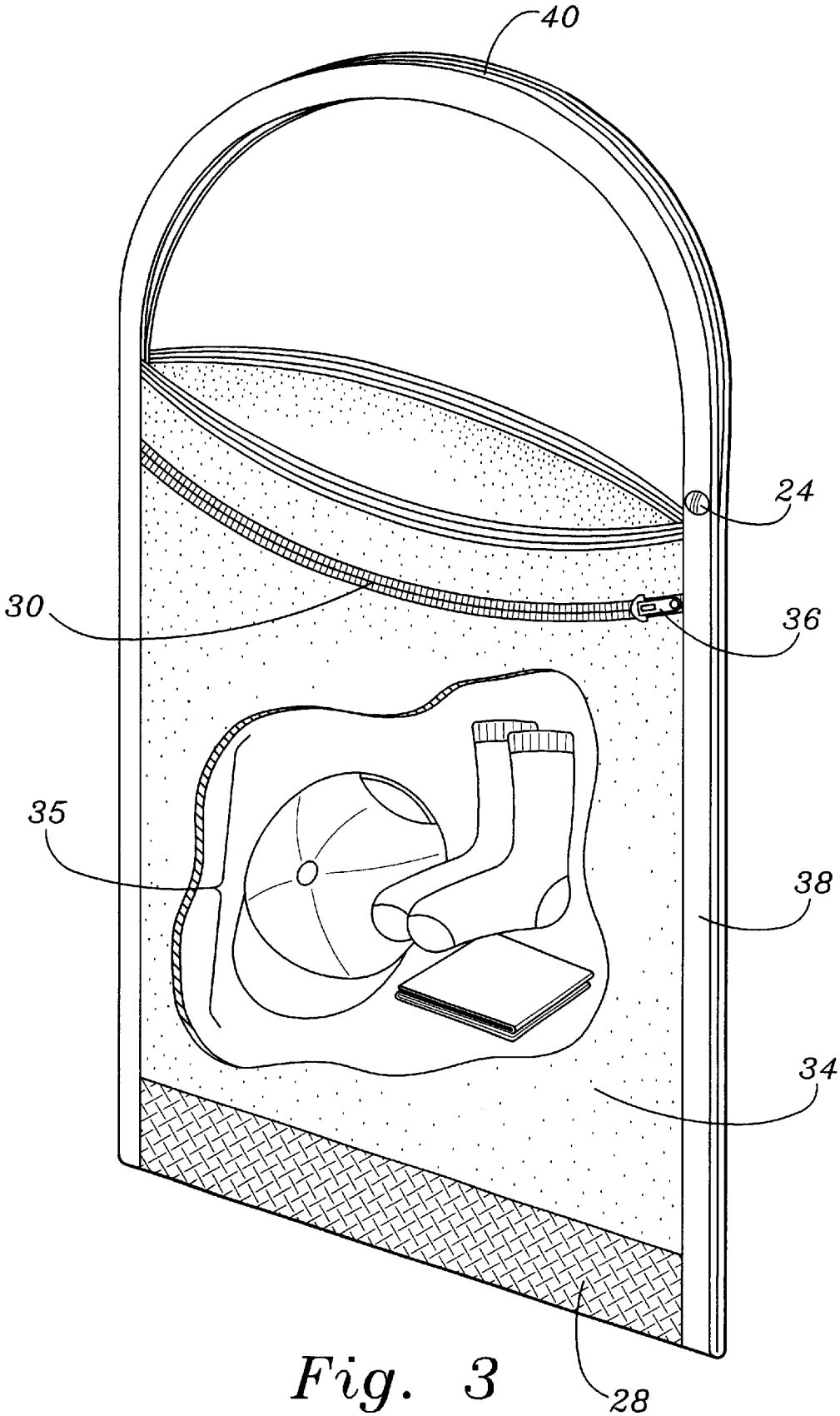
FIG. 3 is a perspective view of the beach towel/tote bag folded into the tote bag configuration, and showing the partially vented, zippered pockets and the carrying handles.

Referring to the drawings and in particular to FIGS. 1 and 2, there is shown a front and back view of the preferred embodiment of a combination beach towel and tote bag in the unfolded position. The combination when folded to a tote bag configuration is further shown in the perspective view of FIG. 3. Also illustrated in FIG. 3 is one of two opposingly located external pockets 34 each having a flexible mesh fabric panel 28 base section, provided as a novel feature to facilitate escape of sand and dirt particles accumulated within the pockets during use.

As used in this description, the term "front side" refers to the combination beach towel and tote bag, when the pockets are oriented toward the viewer, as in FIG. 1. Furthermore, the term "back side" refers to the combination beach towel and tote bag, when the pockets are oriented away from the viewer, and are thus hidden, as in FIG. 2. The title of the invention "beach towel/tote bag" is used to refer to the combination beach towel and tote bag with external pockets, as in FIG. 3. It is noted that for the sake of clarity all the components and parts of the combination beach towel and tote bag may not be shown and/or marked in all the drawings.

Turning now to the drawings in more detail, the front side of the combination beach towel and tote bag with external pockets is shown in FIG. 1. The combination is comprised primarily of a large towel 10 and a small towel 12. The small towel 12 is placed flat over one end section of the large towel 10 covering an area approximately one quarter of the large towel's surface area. The large towel 10 is generally rectangular in shape, sized approximately twice as long as it is wide, but preferably approximately 36 X 68 inches, and made from conventional, flexible, absorbent fabric, for example, terrycloth. Two opposing longitudinal side edges 14 and two opposing transverse side edges 16 define the periphery of the large towel 10.

FIGS. 1 and 2 show two loop tabs 18, comprised of flexible webbing straps, for example nylon, approximately one inch wide and approximately six inches long, sewn at right angles to each of the two longitudinal edges 14 of the large towel 10 at the intersection of said longitudinal edges 14 and the transverse centerline 20. Prior to securing, each loop tab 18 is doubled over itself at its longitudinal centerline and stitched to the large towel's 10 longitudinal edge 14 to a distance of approximately one and one half inches, such that the stitching penetrates all three layers of fabric. One half of a cooperating snap 22, as shown in FIGS. 1 and 2, is secured to each of the two loop tabs 18, with the snap's securing feature facing the back side of the large towel 10. The snaps 22 are located along the center of the loop tabs 18 at a distance of approximately one half inch outside of the longitudinal side edges 14.

A detailed description of the preferred construction of the small towel 12 will now be described in the following text in reference to the various drawing figures.

FIG.1 illustrates the small towel 12, which is generally rectangular in shape, and in its ultimate configuration is comprised of five panels secured to each other by stitch lines oriented parallel to the large towel's 10 longitudinal centerline 26. The small towel 12 is sized to approximately one quarter of the length and of the same width as the large towel 10. With the exception of the centrally located mesh fabric panel 28, the small towel 12 is made primarily of the same or similar conventional, flexible, absorbent fabric, for example, terrycloth, as the large towel 10.

The initial step in assembly of the small towel 12, as shown in FIG. 1, involves cutting the small towel fabric into two equally sized panels, the cut being located at and along the longitudinal centerline 26. A strip of flexible perforated screen or mesh fabric 28 having a constant width of approximately three inches and of a length equal to the small towel's 12 width is stitched to the two small towel 12 half panels along the edges which were cut in the immediately preceding step. The seam lines between mesh fabric panel 28 and small towel 12 halves are made parallel to the longitudinal centerline 26. For the preferred embodiment, the mesh fabric panel 28 perforations are sized to substantially permit unobstructed passage of coarse sand particles. The mesh fabric panel 28 will ultimately form the base section of the external pockets 34, as shown in FIG. 3, and will provided a novel means to facilitate escape of sand and dirt particles accumulated within the pockets during use.

The final step in assembly of the small towel 12, also illustrated in FIG. 1, involves making two pocket access cuts 30 across the entire width of the small towel 12 fabric. Each cut is made parallel to the longitudinal centerline 26 and at a lateral distance of approximately four inches from the small towel's outer edges 32. In the preferred embodiment, both access cuts 30 are thereafter reattached by means of zipper closures 36. Other methods of reattaching the opening are also included in the spirit of the invention, such as buttons, snaps, Velcro, etc., known by those skilled in the art.

The small towel 12 is further secured to the large towel 10 in the following manner. The first step involves placing the fully assembled small towel 12 flat, with the zipper closures 36 facing out, over the matching front side quarter panel at one end of the large towel 10. It is intended that the outer edges 32 of the small towel 12 will match the longitudinal side edges 14 of the large towel 10, and one long side edge of the small towel 12 will match the transverse side edge 16 of the large towel. When properly positioned, the small towel 12 will be located at the extreme right side of the large towel 10 when viewed from the front as shown in FIG. 1. The large towel 10 and small towel 12 are then initially sewn to each other by means of stitching located along the centerline and entire length of the mesh fabric panel 28. The stitching on the mesh fabric panel 28 centerline will overlie the longitudinal centerline 26 of the large towel 10.

The second and final step involves placing the corners of the large towel 10 which are under the small towel 12 corners over each other so that they match and overlie each other. With that condition achieved, the entire periphery of the small towel 12 is stitched to the large towel 10, thereby forming the two external pockets 34, each of which is accessible by means of the zipper closures 36. The periphery stitching is accomplished such that small pleats are incorporated into the mesh fabric panel at both of its extremities, thereby allowing the base of the pocket to expand outwardly to facilitate escape of sand and dirt particles accumulated within the pockets during use.

A strap 38 comprised of continuous flexible webbing, for example nylon, approximately one inch wide, is sewn along the two longitudinal edges of the small towel 12, with the stitching securing all three layers of material, including strap 38, small towel 12, and large towel 10. The strap 38 is extended on each side of the small towel outer edges 32, forming two closed strap loops 40, one on each side of the small towel 12, each said strap loop having a diameter approximately equivalent to the width of the small towel 12. When completely secured, the strap 38 forms a closed, continuous, elongated circular shape as illustrated in FIG. 1. The strap loops 40 will ultimately be used as the tote bag handles when the towel combination is fully folded to the configuration illustrated on FIG. 3.

The matching half of a cooperating snap 24, as shown in FIGS. 1 and 2, is secured to the strap 38, at a point approximately one half inch beyond the corner defined by the intersection of the longitudinal side edge 14 and transverse side edge 16. The cooperating snap's 24 securing feature is installed facing the backside of the large towel 10.

Figure 4:
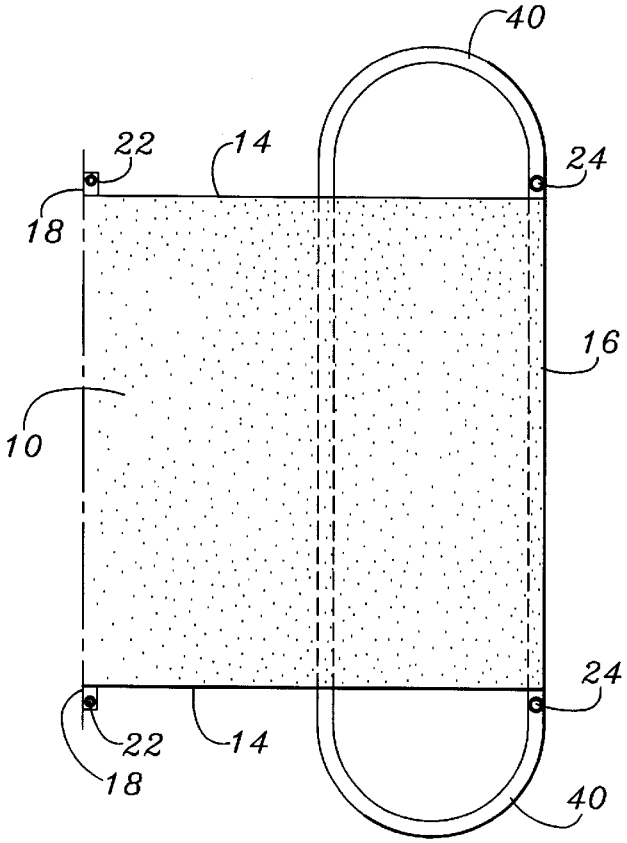
FIG. 4 is a back view of the beach towel/tote bag showing the first step of the folding sequence.
Figure 5:
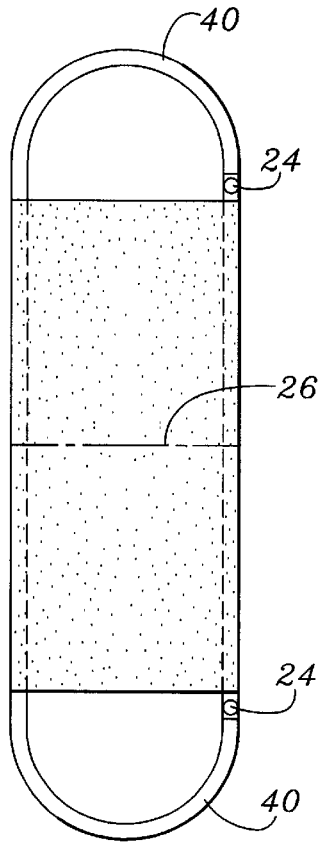
FIG. 5 is a back view of the beach towel/tote bag showing the second step of the folding sequence.
Figure 6:
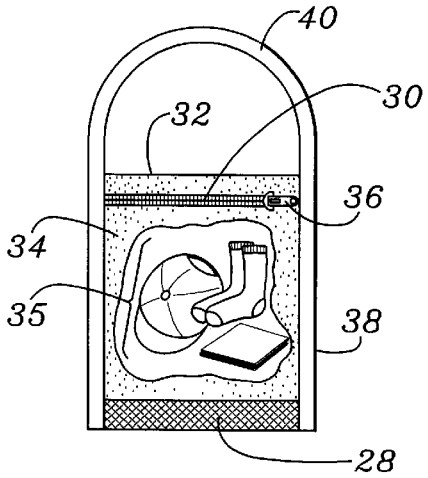
FIG. 6 is a front view of the folded beach towel/tote bag showing the partially vented pockets and carrying handles.

In the preferred embodiment, the beach towel is converted into the tote bag illustrated in FIG. 3 by employing the following novel, simple, easily understood folding sequence, illustrated in FIGS. 4, 5 and 6. The first step involves folding the large towel 10 in half along its transverse centerline 20 such that the backside is facing out as shown in FIG. 4. The large towel 10 is then lifted by holding one set of opposing loop tabs 18 in each hand, and then shaken in an up, down, and sideways motion to loosen and remove sand, dirt or grass particles that have accumulated on its back side. The large towel 10 is then again folded parallel to its transverse centerline 20 forming a quarter segment, back side facing out, as shown in FIG. 5. At this point, the matching cooperating snaps 22 and 24 located on the loop tabs 18 and straps 38, are secured to each other, as shown in FIG. 5. The final fold is made along the longitudinal centerline 26 so that the strap loops 40 line up with each other and the external pockets 34 face out, as shown in FIG. 6. The tote bag is then shaken in an up, down, and sideways direction to loosen and facilitate removal through the novel mesh fabric panel 28 any sand or dirt particles that have accumulated inside the pockets during use.

In the preferred mode of operation, beach towel/tote bag is placed on the ground, grass or sand to lay on, fully unfolded with the external pockets 34 facing down. Soft items, such as articles of clothing, stored within the pockets will form pillows to support the users head when laying on beach towel/tote bag. When fully folded to the tote bag configuration, as illustrated in FIG. 3, beach towel/tote bag can be carried by putting both strap loops 40 on one shoulder, or by putting one strap loop 40 on each shoulder, external pockets 34 facing out, as one would carry a backpack.

In a second novel mode of operation, beach towel/tote bag can be used as a cover by unfolding the final longitudinal fold to the configuration illustrated in FIG. 5, but not disengaging the snaps 22 and 24, placing over the shoulders with the external pockets 34 facing out, and bringing the loop straps 40 around the wearer's front. If desired, arms may be placed through the strap loops 40 to hold beach towel/tote bag on the shoulders.

In a third novel mode of operation, beach towel/tote bag can be used as an extended cover by unfolding to half the large towel's length, the configuration illustrated in FIG. 4, but not disengaging the snaps 22 and 24, placing over the shoulders with the external pockets 34 facing out, and bringing the strap loops 40 around the wearer's front. If desired, arms may be placed through the strap loops 40 to hold beach towel/tote bag on the shoulders.

The previously described versions of the present invention have many advantages, including a beach towel tote bag combination, which incorporates easily accessible external pockets 34 for carrying small articles of clothing and other small items, such as valuables. Conversion from the beach towel mode to the easily carried tote bag mode is accomplished by very simple steps, easily accomplished by all user's, including very young children. No complex folding instructions are required. Furthermore, the towel is folded without use of long zippers subject to jamming from contamination with dirt and sand. Finally, beach towel/tote bag includes the novel mesh fabric panel 28 feature on each external pocket 34 allowing for escape of unwanted sand or dirt accumulated during use. No longer will the sand and dirt be carried home and spilled at the most inappropriate times and places.

Many changes and modifications can be made in the design of the present invention without departing from the spirit thereof. Described below are some of said possible changes and variations.

The mesh fabric panel 28 is not stitched to the large towel 10 at the longitudinal centerline 26. The result will be one large external pocket 34 with access through two zippered closures 36, while still retaining the mesh fabric panel 28 as a novel means to facilitate escape of sand and dirt particles accumulated within the pocket during use. The simple folding sequence and tote bag carrying features previously described would also be employed.

The small towel 12 is not cut in half at the longitudinal centerline 26 and the mesh fabric panel 28 is not provided or stitched in-between the two small towel 12 half sections. The result will be one large external pocket 34 with access through two zippered closures 36. The simple folding sequence and tote bag carrying features previously described would also be employed.

The small towel 12 is not cut in half at the longitudinal centerline 26 and the mesh fabric panel 28 is not provided or stitched in-between the two small towel 12 half sections, but the center of the small towel 12 is sewn to the large towel along the longitudinal centerline 26. The result will be two external pockets 34 with access through two zippered closures 36. The simple folding sequence and tote bag carrying features previously described would also be employed.

Zipper closures 36 would not be provided for the external pockets 34. Instead, the pockets would remain open, or other closure means, such as buttons, snaps, Velcro, etc. would be provided.

The small towel 12 would not be used, thus excluding the external pockets 34 altogether. Loop tabs 18, the strap 38, the strap loops 40, and snaps 22 and 24 would be provided in the same manner as for the preferred embodiment, thus maintaining the same folding features and tote bag configuration.

The large towel 10 would be sized smaller for use by a child, as for example to a rectangular shape approximately 30×60 inches. Other related elements, such as the small towel 12 would be correspondingly reduced in size.

Although the present invention has been described in considerable detail with reference to certain preferred versions thereof, other versions are possible, and some have been described. Therefore, the spirit and scope of the appended claims should not be limited to the description of the preferred versions contained therein.

What is claimed is:

1. A beach towel and integral tote bag with externally accessible storage pockets, the combination comprising:

a) a large rectangular towel of flexible, absorbent, fabric approximately twice as long as it is wide and having longitudinal side edges, transverse side edges, and a front and a back surface;

b) two loop tabs, comprised of flexible webbing straps sewn at substantially right angles to and extending out from each of the large towel's longitudinal side edges at the longitudinal centerline, each said loop tab having half of a first cooperating snap facing the back surface;

c) a small rectangular towel of flexible, absorbent, fabric having a length approximately equal to the width of the large towel and a width approximately equal to one fourth the length of the large towel and having two long side edges, two short side edges, and a front and a back surface;

d) a first and a second small towel panel formed by cutting the small towel fabric in half substantially along the midpoint of the two long side edges;

e) a third small towel panel of flexible perforated mesh fabric or netting, with perforations sized to substantially permit passage of coarse sand particles, said panel being approximately three inches wide and as long as the small towel's width, and stitched to the front surface of the first and second small towel panels along the third panel's two long side edges and the previously cut first and second panel side edges;

f) a fourth and a fifth small towel panel formed by cutting the small towel fabric across its entire width approximately four inches from the short side edge opposite the short side edges securing the third small towel panel;

g) a pair of zippers closures extending the full width of the small towel stitched to and thereby reattaching the fourth and fifth small towel panels to the remainder of the small towel in substantially the same orientation occupied prior to cutting the small towel fabric to form the fourth and fifth panels;

h) said front surface of the small towel, comprised of a plurality of panels, being placed substantially flat over the front surface of the large towel, zippers facing out, and two transverse comers of the large towel substantially matching and overlaying two corresponding small towel long side edge corners;

i) said front surface of the small towel, being stitched along its perimeter and along the longitudinal centerline of the third panel, to the front surface of one quarter section of the large towel bordering the transverse edge, incorporating pleats at the longitudinal extremities of the mesh fabric panels, thus forming two storage pockets between the large towel and the small towel, each pocket being openable and closable by means of zippers, and each pocket having a perforated mesh fabric or netting panel along the centerline of the large towel to facilitate escape of sand or dirt particles accumulated within the pockets;

j) a continuous strap having a first portion stitched flat over the combined towels along the small towel's first long side edge and extending past the large towel's longitudinal side edge forming a first closed loop having a diameter substantially equal to the width of the small towel and having a second portion stitched flat over the combined towels along the small towel's second long side edge and extending past the large towel's second longitudinal side edge forming a second closed loop having a diameter substantially equal to the first closed loop;

k) two second cooperating snaps, one each secured to each of the strap loops facing the back surface, located beyond the corners of the large towel's longitudinal and transverse side edges;

whereby when said large towel is first folded at the transverse centerline to half its length on its back surface, secondly folded to one quarter of its length on its back surface, and thirdly folded to one half its width at the longitudinal centerline, such that the cooperating snaps on the opposing loop tabs and strap loops will engage securing the large towel in the folded mode, forming a tote bag, pockets facing out to enable release of unwanted dirt and sand particles through the perforated mesh fabric panels, and is carried by placing the handles formed by the strap loops on one shoulder.

2. A beach towel and integral tote bag with externally accessible storage pockets as defined in claim 1 wherein the third small towel panel of flexible perforated mesh fabric or netting is not stitched to the large towel's longitudinal centerline thereby forming one large pocket between the small towel and the large towel.

3. A beach towel and integral tote bag with externally accessible storage pockets as defined in claim 1 wherein a plurality of buttons is provided as the fastening means for securing the external pockets.

4. A beach towel and integral tote bag with externally accessible storage pockets as defined in claim 1 wherein each pocket is openable and closeable by means of hook and loop synthetic materials which adhere when pressed together.

5. A beach towel and integral tote bag with externally accessible storage pockets as defined in claim 1 wherein a plurality of snaps is provided as the fastening means for securing the external pockets.

6. A beach towel and integral tote bag with externally accessible storage pockets as defined in claim 1 wherein the large towel has a width from 30 to 36 inches and a length of from 60 to 68 inches.

7. A beach towel and integral tote bag with externally accessible storage pockets as defined in claim 1 which is carried as a backpack by placing the handles formed by the strap loops, one on each shoulder.

8. A beach towel and integral tote bag with externally accessible storage pockets as defined in claim 1 wherein the pockets are filled with a plurality of soft items for use as a headrest pillow to support the user's head when laying thereupon.

9. A beach towel and integral tote bag with externally accessible storage pockets as defined in claim 1 which converts to a shoulder cover by unfolding the final longitudinal fold, placing over the shoulders, pockets facing out, and which is secured to the wearer by the handles formed by the strap loops.

10. A beach towel and integral tote bag with externally accessible storage pockets as defined in claim 1 which converts to an extended shoulder and back cover by unfolding the final longitudinal fold and the final transverse fold, placing over the shoulders, pockets facing out, and which is secured to the wearer by the handles formed by the strap loops.

11. A beach towel and integral tote bag, the combination comprising:

a) a large rectangular towel of flexible, absorbent, fabric approximately twice as long as it is wide and having longitudinal side edges, transverse side edges, and a front and a back surface;

b) two loop tabs, comprised of flexible webbing straps sewn at substantially right angles to and extending out from each of the large towel's longitudinal side edges at the longitudinal centerline, each said loop tab having half of a first cooperating snap facing the back surface;

c) a continuous strap having a first portion stitched flat over one of the large towel's longitudinal side edges and extending past the large towel's longitudinal side edge forming a first closed loop having a diameter substantially equal to the one fourth the length of the large towel and having a second portion stitched flat parallel to the first portion and transversely across the large towel and extending past the large towel's second longitudinal side edge forming a second closed loop having a diameter substantially equal to the first closed loop;

d) two second cooperating snaps, one each secured to each of the strap loops facing the back surface, located beyond the corners of the large towel's longitudinal and transverse side edges;

whereby when said large towel is first folded at the transverse centerline to half its length on its back surface, secondly folded to one quarter of its length on its back surface, and thirdly folded to one half its width at the longitudinal centerline, such that the cooperating snaps on the opposing loop tabs and strap loops will engage securing the large towel in the folded mode, forming a tote bag, which is carried by placing the handles formed by the strap loops on one shoulder.

12. A beach towel and integral tote bag defined in claim 11 wherein the large towel has a width from 30 to 36 inches and a length of from 60 to 68 inches.

13. A beach towel and integral tote bag as defined in claim 11 which is carried as a backpack by placing the handles formed by the strap loops, one on each shoulder.

14. A beach towel and integral tote bag as defined in claim 11 which converts to a shoulder cover by unfolding the final longitudinal fold, placing over the shoulders, and which is secured to the wearer by the handles formed by the strap loops.

15. A beach towel and integral tote bag as defined in claim 11 which converts to an extended shoulder and back cover by unfolding the final longitudinal fold and the final transverse fold, placing over the shoulders, and which is secured to the wearer by the handles formed by the strap loops.

16. A beach towel and integral tote bag with externally accessible storage pockets, the combination comprising:

a) a large rectangular towel of flexible, absorbent, fabric approximately twice as long as it is wide and having longitudinal side edges, transverse side edges, and a front and a back surface;

b) two loop tabs, comprised of flexible webbing straps sewn at substantially right angles to and extending out from each of the large towel's longitudinal side edges at the longitudinal centerline, each said loop tab having half of a first cooperating snap facing the back surface;

c) a small rectangular towel of flexible, absorbent, fabric having a length approximately equal to the width of the large towel and a width approximately equal to one fourth the length of the large towel and having two long side edges, two short side edges, and a front and a back surface;

d) a plurality of small towel panels formed by cutting both long sides of the small towel fabric across its entire width approximately four inches from the short side edges;

e) a pair of zippers closures, extending the full width of the small towel, stitched to and thereby reattaching the plurality of small towel panels in substantially the same orientation occupied prior to cutting the small towel fabric to form the plurality of panels;

f) said front surface of the small towel, comprised of a plurality of panels, being placed substantially flat over the front surface of the large towel, zippers facing out, and two transverse corners of the large towel substantially matching and overlaying two corresponding small towel long side edge corners;

g) said front surface of the small towel, being stitched along its perimeter and along its transverse centerline, to the front surface of one quarter section of the large towel bordering the transverse edge, thus forming two storage pockets between the large towel and the small towel, each pocket being openable and closable by means of zippers;

h) a continuous strap having a first portion stitched flat over the combined towels along the small towel's first long side edge and extending past the large towel's longitudinal side edge forming a first closed loop having a diameter substantially equal to the width of the small towel and having a second portion stitched flat over the combined towels along the small towel's second long side edge and extending past the large towel's second longitudinal side edge forming a second closed loop having a diameter substantially equal to the first closed loop;

i) two second cooperating snaps, one each secured to each of the strap loops facing the back surface, located beyond the corners of the large towel's longitudinal and transverse side edges;

whereby when said large towel is first folded at the transverse centerline to half its length on its back surface, secondly folded to one quarter of its length on its back surface, and thirdly folded to one half its width at the longitudinal centerline, such that the cooperating snaps on the opposing loop tabs and strap loops will engage securing the large towel in the folded mode, forming a tote bag, pockets facing out, and which may be carried by placing the handles formed by the strap loops on one shoulder.

17. A beach towel and integral tote bag with externally accessible storage pockets as defined in claim 16 wherein the small towel is not stitched to the large towel's longitudinal centerline thereby forming one large pocket between the small towel and the large towel.

* * * * *